United States Patent [19]

Bond

[11] 4,035,883

[45] July 19, 1977

[54] MULTIPURPOSE INTERMINGLING JET AND PROCESS

[75] Inventor: Norman John Bond, Pineville, N.C.

[73] Assignee: Fiber Industries, Inc., Charlotte, N.C.

[21] Appl. No.: 558,571

[22] Filed: Mar. 14, 1975

[51] Int. Cl.[2] ..... D02G 1/20; D02G 1/16

[52] U.S. Cl. ..... 28/220; 28/246; 28/276

[58] Field of Search ..... 28/1.3, 1.4, 71.3, 72.12, 28/72.11

[56] References Cited

U.S. PATENT DOCUMENTS

| | | | |
|---|---|---|---|
| 2,638,146 | 5/1953 | Rounseville et al. | 28/72.12 X |
| 3,143,784 | 8/1964 | Scott | 28/71.3 |
| 3,167,847 | 2/1965 | Gonsalves | 28/72.12 X |
| 3,220,082 | 11/1965 | Fletcher et al. | 28/1.4 |
| 3,279,164 | 10/1966 | Breen et al. | 57/157 F |
| 3,303,169 | 2/1967 | Pitzl | 28/1.3 X |
| 3,329,757 | 7/1967 | Johnson | 264/282 |
| 3,364,537 | 1/1968 | Bunting et al. | 28/1.4 |
| 3,535,755 | 10/1970 | Brown | 28/1.4 |
| 3,701,248 | 10/1972 | Gray | 28/1.4 X |
| 3,724,040 | 4/1973 | Ohayon | 28/1.4 |
| 3,727,274 | 4/1973 | White | 28/1.4 |
| 3,816,992 | 6/1974 | Frankfort et al. | 28/72.12 X |
| 3,849,846 | 11/1974 | Ethridge | 28/1.4 |
| 3,854,313 | 12/1974 | Heichlinger et al. | 28/72.12 |
| 3,892,020 | 7/1975 | Koslowski | 28/72.12 |

*Primary Examiner*—Louis K. Rimrodt
*Attorney, Agent, or Firm*—Robert J. Blanke

[57] ABSTRACT

Apparatus and process for intermingling a synthetic continuous filament multifilament yarn at substantially any point on a synthetic filament yarn threadline by subjecting the yarn to simultaneous action of two opposed fluid jets which are radial and perpendicular to the yarn threadline. The apparatus has a yarn processing bore which is circular in cross-section and has a length to diameter ratio of from 1 to 2 to 2 to 1. The air entry ports of the apparatus are radial to the bore and opposed to each other in a common plane which is substantially perpendicular to the longitudinal axis of the bore.

7 Claims, 4 Drawing Figures

MULTIPURPOSE INTERMINGLING JET AND PROCESS

This invention relates to intermingling jets for multifilament yarns and processes for the preparation of intermingled multifilament yarns. More specifically, the invention relates to laceable jets suitable for filament intermingling at substantially any point on a synthetic filament threadline.

It is well-known in the textile industry that continuous filament yarn bundles in their "as spun" or zero-twist configurations perform poorly in many of the common textile operations such as winding, weaving, knitting and the like, primarily due to a looseness of structure that permits individual filaments to snag and break, thence forming fluff balls, slubs, ringers, wraps, strip backs or similar defects. Zero-twist yarns also have a tendency to run in the form of a ribbon over guides, rollers and so forth, whereby as a result of increased frictional contact, the yarns are more readily abraded and subject to breakage. As a result of these shortcomings, continuous filament producers usually carry out the additional step of twisting each continuous filament yarn bundle to provide an acceptable starting product. The twisting operation serves to compact and unify the yarn bundle, thus resulting in a more cohesive structure which resists the pulling out of individual filaments. The twisting operation, however, is expensive and time consuming and does not lend itself to the continuous operation which characterizes much of the manufacturing sequence in the preparation of the zero-twist continuous filament yarn bundle.

In order to overcome the expense of the twisting operation, and also to employ a twist substitute manufacturing operation, which is adaptable to the continuous manufacturing operation employed in the manufacture of continuous filament yarn bundles, compact interlaced yarns have recently been introduced to the textile yarns of the type presently under discussion are set forth in U.S. Pat. No. 2,985,995. In brief, the compact interlaced multifilament textile yarns of the prior art are produced by subjecting an as-spun substantially zero-twist continuous filament yarn bundle to the action of one or more fluid jets, whereby individual filaments are randomly intermingled with adjacent filaments and groups of filaments along the length of the yarn to maintain the unity of the yarn by frictional constraint between the filaments. Yarns of this type have been found to be satisfactory for such textile operations as winding, beaming, knitting and weaving.

It is also known that a reduction in filament breakage during yarn drawing operations may be obtained if the filaments of the freshly spun yarns are intermingled in the draw zone. Moreover, random breakouts are caused by broken filaments wrapping on the rolls in the drawing operation. The wrapping of broken filaments can be prevented by intermingling the filaments such that when broken, an individual filament is restrained by the yarn bundle and cannot wrap. Intermingling apparatus and processes of the prior art, however, have had a tendency to reduce certain physical properties of the finished yarn product, presumably due to high fluid pressures as well as excessive contact between the filaments of the yarn bundle and the walls of the yarn processing bore of the intermingling apparatus. In addition to reducing the physical properties of yarn, high fluid pressures result in high noise levels and excessive energy consumption. Moreover, the yarn damaging effects of prior art compaction apparatus has prevented the positioning of such apparatus at substantially all points along a thermoplastic synthetic filament threadline.

It is therefore an object of this invention to provide a yarn intermingling apparatus which is operative at any point on a thermoplastic synthetic filament threadline without substantially reducing physical properties in the finished yarn product.

It is still another object of this invention to provide an intermingling process for producing thermoplastic continuous filament yarn at low noise levels, low fluid pressures and velocities and low energy consumption.

In accordance with this invention, it has now been discovered that a yarn intermingling apparatus suitable for positioning at any point on a synthetic filament threadline is achieved by a design wherein a bore adapted for the passage of multifilament yarn therethrough has two fluid inlets, each of the inlets being radial to the bore and opposed to each other in a common plane which is substantially perpendicular to the longitudinal axis of the bore. The yarn processing bore which is circular in cross-section has a length to diameter ratio of from 1 to 1 to 2 to 1. The air entry ports have a cross-sectional area not exceeding the cross-sectional area of the yarn processing bore. Preferably, the apparatus has lacing or string-up means. Lacing or string-up of the apparatus is achieved by dividing the apparatus into two sections along the longitudinal axis of the yarn processing bore. One of the sections is caused to be aligned by and ride upon a pair of dowel pins which are interference fit in the opposite section, the sections being urged together by means of a rectilinear motion spring linkage system. The sections are conveniently opened by means of a lever which is secured to an eccentric cam which in turn actuates push rods causing said sections to be forced apart. In addition to facilitating string-up or threading, the design of the apparatus of the instant invention is such that in the event a residual gap exists upon closure of the two sections due to, for instance, trapped dirt or lint, air or other operating fluid employed in the operation of the apparatus will leak through the residual gap and purge the gap thereby preventing ingress of filamentary matter being treated.

The process of this invention employs fluid energy to vibrate and disperse filaments and swirl them together with such momentum and confusion that they become intermingled and obtain coherency factors (hook drop) of from 5 to $>1000$. The process comprises simultaneously subjecting a multifilament yarn bundle at substantially any point on a thermoplastic synthetic filament threadline and most preferably between the spinneret and the draw zone to two radially opposed fluid jets. The jets are operated at pressures from 5 pounds per square inch gauge to 100 pounds per square inch gauge and velocities of 200 feet per second to 1100 feet per second, yarn tensions on entry and exit are from $<0.1$ grams per denier to $>1$ grams per denier and running speeds of from 20 feet per minute to over 12,000 feet per minute. Preferably, the yarn has a total denier of at least 20 and still more preferably from 40 to 10,000. Air consumptions are from ¼ to a standard cubic foot per minute to 12 standard cubic feet per minute when the apparatus of this invention is in the closed position. Yarn exposure time to the apparatus of this invention are not more than 0.07 second. The process of this invention is found to be operative at noise levels not exceeding 85 decibels.

The phrase "coherency factor (hookdrop)" as employed herein defines coherency factor as measured by the hook drop test. The hook drop test is conducted by clamping a sample of yarn in a vertical position under the tension provided by a weight in grams which is 0.20 times the yarn denier (but not greater than 100 grams). A weighted hook, having a total weight in grams numerically equal to the mean denier per filament of the yarn (but weighing not more than 10 grams) is inserted through the yarn bundle and lowered at a rate of 1 to 2 centimeters per second until the weight of the hook has traveled through the yarn characterizes the extent of filament entanglement. The result is expressed as a CF or coherency factor which is defined as 100 divided by the above distance in centimeters.

A better understanding of the invention may be had from a description of the drawings wherein.

Figure 1:
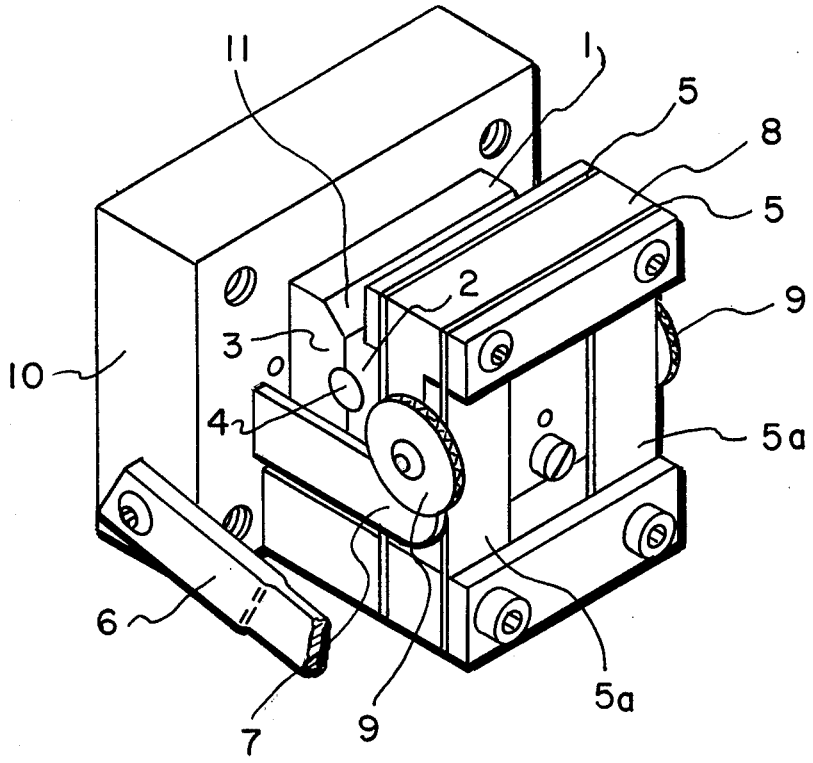
FIG. 1 is a projected partial phantom view, not to scale, of the intermingling apparatus of this invention.

Turning to FIG. 1, a segmented block 1 made up of right-hand segment 2 and left-hand segment 3 has a cylindrical bore 4 disposed therein. Segmented block 1 is sandwiched between bracket members 8 and 10. Right-hand segment 2 and left-hand segment 3 are urged together by spring pair members 5 and 5*a*. Spring pair members 5 and 5*a* are maintained in a tensioned position when right-hand segment 2 and left-hand segment 3 are in a closed position, that is to say, the segments are always in a spring loaded state to prevent the tendency of fluid pressure or other forces to force said members apart. As illustrated in FIG. 1, the apparatus is in its operating position. The apparatus is conveniently laced, that is to say, has yarn inserted therein by rotating lever arm 6 which is in operating contact with an eccentric cam member (not illustrated). The cam member forces push rods 7, which are positioned on either side of segmented block 1, out thereby causing bracket member 8 to which said push rods 7 are secured by means of their respective thumb screws 9, to be forced out. One of said push rods 7 is hidden from view but it should be understood that the push rods 7 are in parallel alignment so as to assure rectilinear movement of right-hand segment 2. Right-hand segment 2 which is secured to bracket member 8 is accordingly caused to move away from left-hand segment 3. A threadline may then be passed down through the V notch 11 into the cylindrical bore. Suitable guides or pin members (not illustrated) may be placed on the threadline to prevent the yarn from dropping below the yarn process bore 4. Access to cylindrical bore 4 is then closed by releasing lever member 6 whereby push rods 7 retract and spring pair members 5 and 52 urges right-hand segment 2 and left-hand segment 3 together.

Figure 3:
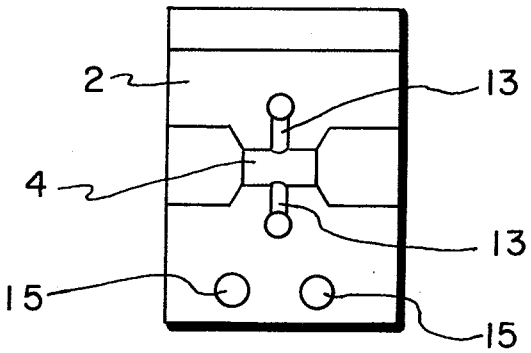
FIG. 3 is a cross sectional view taken along the line III,III of FIG. 2.
Figure 2:
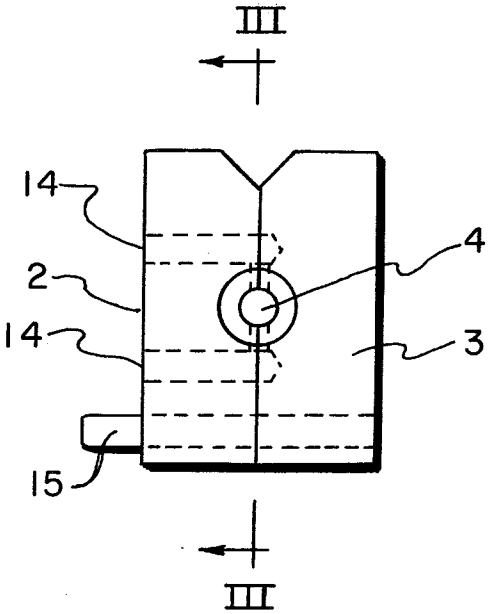
FIG. 2 is a partial phantom front view of the two sections comprising the two sections making up the yarn processing bore of the apparatus of this invention.

As previously stated, the opening motion for the apparatus of this invention is rectilinear motion. As can be seen in FIGS. 2 and 3, a pair of guide pins 15 are positioned parallel to each other and interference fit perpendicular to the juncture face of left-hand segment 3. Right-hand segment 2 may then be caused to ride on guide pins 15. As heretofore discussed, the spring loaded system is designed to ensure rectilinear motion of right-hand segment 2, minimizing any tendency to bind or sieze on guide pins 15.

The internal geometry of the jet itself may be better understood from FIG. 2 and 3. As can be seen from the partial phantom front view of FIG. 2 and the cross sectional view of FIG. 3 taken along the line III,III, yarn processing bore 4 is circular in cross section, the length being about twice the diameter, the length not including the flared portions at either bore extremity. The air entry ports 13 are opposed to each other and are perpendicular and radial to the longitudinal axis of yarn processing bore 4. Processing fluid is supplied to air entry ports 13 by means of a pair of fluid lines 14 which intersect said air entry ports.

Figure 4:
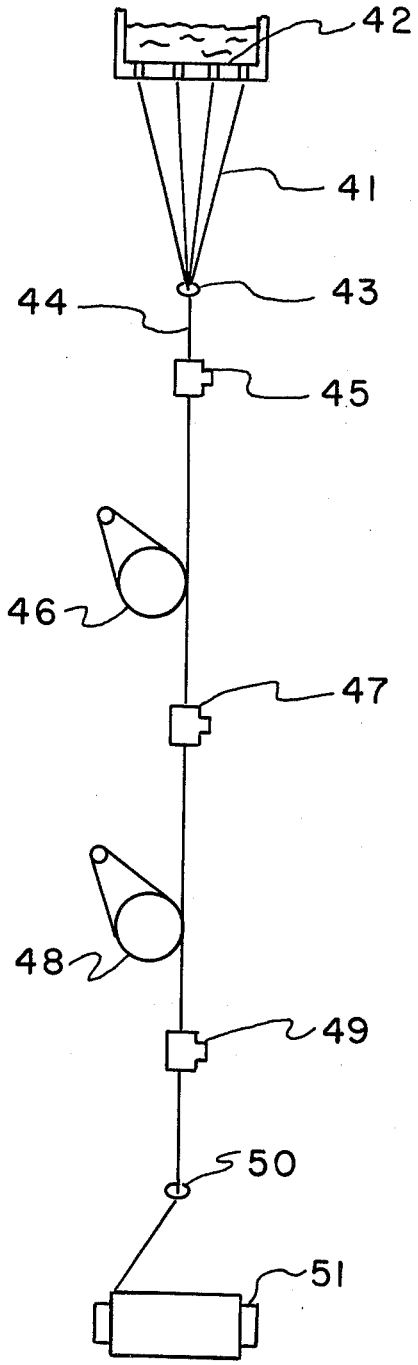
FIG. 4 is a schematic illustration of an assembly employing the compaction apparatus of this invention to improve the runnability of a synthetic yarn threadline.

While the compaction jet of this invention may be positioned at substantially any point on a synthetic filament threadline, it is quite surprising that the apparatus functions so as to improve filament runnability when positioned in advance of the first draw roll in a melt spun filament forming operation. Preferably a coherency factor of at least about 10 is obtained in the spun filament prior to drawing. As can be seen in FIG. 4 of the drawings, filaments 41 issuing from spinneret 42 converge at guide 43 into yarn 44 and finish is preferably applied to the yarn prior to passage through a compaction jet 45. The compacted yarn then passes around a feed-roll assembly 46, through a draw zone and in multiple wraps around a draw roll assemby 48. The compaction jet 45 compacts yarn 44 so as to prevent the lap up of broken filaments on feed-roll assembly 46. The compaction of yarn 44 by the compaction jet 45 also prevents broken filaments from snapping back and adhering to the face of spinneret 42. Preferably, a compaction jet 47 is positioned in the draw zone intermediate feed roll assembly 46 and draw roll assembly 48. A final compaction treatment is conducted on the yarn by positioning compaction jet 49 downstream of draw roll assembly 48. The yarn is then passed through guide 50 and taken up on a conventional packaging means 51.

The apparatus of this invention is suitable for processing a wide variety of continuous multifilament yarn structures. The yarn structures may be flat or textured of substantially any total denier and the individual filaments of the yarn bundle may have substantially any cross section. For industrial applications, a round cross section is preferred.

The yarn structures may be composed either partially or entirely of synthetic polymeric materials, such as the polyamides (nylon), e.g.,poly(ε-caproamide) and poly(-hexamethylene adipamide); polyesters, e.g., poly(ethylene terephthalate); acrylic polymers, such as poly(acrylonitrile) and/or the many copolymers thereof, vinyl polymers, e.g., poly(vinyl chloride), poly(vinylidene chloride) or copolymers thereof; hydrocarbon polymers, such as polyethylene or polypropylene; and cellulosic polymers such as regenerated cellulose and cellulose ethers or esters.

As previously mentioned, the apparatus of this invention is suitable for use at substantially any place on a synthetic filament threadline. The apparatus, however, has its greatest utility when positioned upstream of the drawing operation in a thermoplastic synthetic filament threadline. The following specific example is given to illustrate the advantages of intermingling a synthetic filament bundle prior to the first draw roll.

EXAMPLE 1

Polyethylene terephthalate is melt spun at a temperature of 305° centigrade through a spinneret containing 38 round holes. The material is found have an intrinsic viscosity of 0.65. The yarn is extruded and after solidification at a point where fusion and filament deformation is no longer possible, the yarn is lubricated and then subjected to the compaction apparatus as set forth in the drawings, wherein the yarn processing bore is ⅛ inch in diameter and ¼ inch in length and the air entry ports are 1/16 in diameter. At running speeds of 8,500 feet per minute, the following compaction values were obtained:

| Maximum Air Pressure | Total Denier | Coherency Factor |
|---|---|---|
| 20 p.s.i.g. | 300 | 12.94 |
| 40 p.s.i.g. | 301 | 17.15 |
| 60 p.s.i.g. | 308 | 36.36 |
| 70 p.s.i.g. | 305 | 27.32 |

The compacted yarns are subjected to a continuous single stage drawing operation employing a draw ratio of about 5.0 to 1. Runnability is found to be excellent with substantially no lapping of broken filaments on the draw rolls.

EXAMPLE 2

The process of Example 1 is repeated except that a compaction jet as set forth in FIGS. 1 and 2 of U.S. Pat. No. 3,364,537 is employed. The yarn processing bore of this compaction jet is 9/100 of an inch in diameter and 9/16 of an inch in length. The air entry ports of the patented jet are 4/100 of an inch. At running speeds of 8,500 feet per minute, the following compaction values were obtained:

| Maximum Air Pressure | Total Denier | Coherency Factor |
|---|---|---|
| 20 p.s.i.g. | 310 | no value |
| 40 p.s.i.g. | 295 | no value |
| 60 p.s.i.g. | 305 | no value |
| 70 p.s.i.g. | 306 | no value |

Compaction is found to be insufficient to obtain a value by means of the hook drop test. When the yarn was subjected to the same drawing conditions as employed in Example I, poor runnability and serious lap up of broken filaments on the draw rolls followed by a breaking of the threadline is experienced.

The apparatus of the instant invention is also suitable for terminal compaction, that is to say, compaction after substantially all other yarn processing conditions have been completed. Representative of this type of process os the following Example:

EXAMPLE 3

Polyethylene terephthalate is melt spun at a temperature of 300° centigrade through a spinneret containing 192 round holes. The material is found to have an intrinsic viscosity of 0.89 and a total denier of 6000. The yarn is then drawn so as to give a draw ratio of about 6 to 1 and a final denier of about 1000. At running speeds of about 7000 feet per minute, the yarn is passed into the compaction jet as set forth in the drawings, wherein the yarn processing bore is ⅛ inch in diameter and ¼ inch in length and the air entry ports are 1/16 inch in diameter. When an air pressure of 86 p.s.i.g. is employed, an average coherency factor of 46.9 is obtained.

EXAMPLE 4

Polyethylene terephthalate is melt spun at a temperature of 300° centigrade through a spinneret containing 72 round holes. The material is found to have an intrinsic viscosity of 0.655 and a total denier of 1150. The yarn is taken up on a parallel wound package and then fed into a draw twister where the yarn is drawn to give a draw ratio of about 5 to 1 while obtaining ¼ turn per inch of twist in the yarn. The twisted yarn having a total denier of about 230 is then passed into the compaction jet as set forth in the drawings, wherein the yarn processing bore is ⅛ inch in diameter and ¼ inch in length and the air entry ports are 1/16 inch in diameter. The air pressures and tensions of the following table are then found to yield coherency factors of from 12.8 to 1176 when tested without backing out the real twist. From intermingled control yarn is found to have a coherency factor of 2.7 without backing out real twist.

| Total Tension in Grams | Pressure in Pound Per Square Inch Gauge | Coherency Factor |
|---|---|---|
| 6 | 20 | 382 |
| 6 | 30 | 781 |
| 6 | 40 | 1176 |
| 6 | 50 | 719 |
| 6 | 60 | 1515 |
| 6 | 70 | 1670 |
| 12 | 20 | 263 |
| 12 | 30 | 562 |
| 12 | 40 | 538 |
| 12 | 50 | 633 |
| 12 | 60 | 1031 |
| 12 | 70 | 990 |
| 50 | 70 | 13.8 |
| 100 | 70 | 12.8 |
| 200 | 70 | 25.6 |
| 300 | 70 | 15.8 |

As previously noted, the apparatus of the instant invention has utility when positioned upstream of the drawing operation in a thermoplastic synthetic filament threadline. A special category of compaction prior to drawing is draw texturing. It has been found quite surprisingly that the apparatus of this invention improves the performance of the textured yarn end product when the apparatus is positioned upstream of the texturing point in a thermoplastic synthetic filament draw texturing process. Illustrative of such a draw texturing process is that process set forth in U.S. Pat. No. 3,708,970. The following specific example is given for purposes of illustration.

EXAMPLE 5

Polyethylene terephthalate is melt spun at a temperature of 305° centigrade through a spinneret containing 30 round holes. The as-spun product is found to have an intrinsic viscosity of 0.65 and a total denier of 230 and is fed, after solidification, at a point where fusion and filament deformation is no longer possible at a speed of 5000 feet per minute into the intermingling apparatus of this invention. The intermingling apparatus employed has a yarn process bore which is ⅛ inch in diameter and ¼ inch in length and air entry ports which are 1/16 inch in diameter. The intermingling apparatus is operated at air pressure of about 60 pounds per square inch gauge so as to intermingle the as-spun yarn. The yarn is then taken up on a parallel wound package. After packaging, the yarn is passed over a feed roll, across a hot plate maintained at a temperature of about 230° centigrade, through a false twist spindle of the tube type operated at about 370,000 rotations per minute and then around draw rolls operated at peripheral speeds such as to produce a draw ratio of about 2 to 1. The yarn is then passed over a second hot plate maintained at a temperature of about 190° centigrade, passed around a relax roll and then packaged.

The process is repeated with the exception that the intermingling apparatus is not employed. The yarn from both processes is then warp knit into fabrics. It is found that the warp knit product produced from the textured yarn which had been subjected to the intermingling operation exhibited fewer defects per rack of fabric than the non-intermingled textured control yarn product.

Having thus disclosed the invention, what is claimed is:

1. In a continuous filament-forming process for the preparation of drawn thermoplastic yarns, the improvement comprising the step of compacting as-spun yarn to coherency factors of from 5 to >1000, after solidification of said yarn, at a point where fusion and filament deformation is no longer possible, and then drawing the compacted yarn, said compacting step being conducted with an intermingling jet suitable for operation at low fluid pressures and velocities, said jet containing a substantially circular cross-section bore adapted for passage of multifilament yarn therethrough, and two fluid inlets leading into said bore, said two inlets being axially opposed and centrally disposed and perpendicular to the longitudinal axis of said bore, said bore having length-to-diameter ratio of 1:1 to 2:1, said fluid inlets having a cross-sectional area less than that of said bore.

2. The process of claim 1 wherein said jet is operated at fluid pressures of from 5 to 100 pounds per square inch gauge and fluid velocities of from 200 to 1100 feet per second.

3. The process of claim 1 wherein said drawing operation is conducted during a texturing operation.

4. The process of claim 1 wherein said yarn is also compacted during said drawing operation.

5. The process of claim 1 wherein said yarn is also compacted subsequent to said drawing operation.

6. The process of claim 1 wherein a coherency factor of at least 10 is obtained in compacting said yarn prior to said initial drawing operation

7. The process of claim 1 wherein said bore of said jet has flared ends.

* * * * *